US006619094B2

(12) United States Patent
Juhl

(10) Patent No.: US 6,619,094 B2
(45) Date of Patent: Sep. 16, 2003

(54) METHOD AND APPARATUS FOR FORMING A METAL SHEET UNDER ELEVATED TEMPERATURE AND AIR PRESSURE

(75) Inventor: Knut Juhl, Bremen (DE)

(73) Assignee: Airbus Deutschland GmbH, Hamburg (DE)

( * ) Notice: Subject to any disclaimer, the term of this patent is extended or adjusted under 35 U.S.C. 154(b) by 0 days.

(21) Appl. No.: 10/029,422

(22) Filed: Dec. 19, 2001

(65) Prior Publication Data

US 2002/0095967 A1 Jul. 25, 2002

(30) Foreign Application Priority Data

Dec. 19, 2000 (DE) ..... 100 63 287

(51) Int. Cl.[7] ..... B21D 11/02
(52) U.S. Cl. ..... 72/296; 72/54; 72/342.6
(58) Field of Search ..... 72/296, 297, 54, 72/56, 342.1, 342.2, 342.6

(56) References Cited

U.S. PATENT DOCUMENTS 2,737,224 A * 3/1956 Jones
2,752,982 A * 7/1956 Lalli
2,808,501 A 10/1957 Kilpatrick et al.
2,952,294 A * 9/1960 Beverley
6,063,216 A 5/2000 Damm et al.

FOREIGN PATENT DOCUMENTS

| | | | |
|---|---|---|---|
| DE | 749725 | 12/1944 | |
| FR | 1224629 | * 6/1960 | ..... 72/297 |
| GB | 543040 | 2/1942 | |

* cited by examiner

*Primary Examiner*—Daniel C. Crane
(74) *Attorney, Agent, or Firm*—W. F. Fasse; W. G. Fasse

(57) ABSTRACT

A drawing mold has a contoured mold surface receiving a metal sheet thereon. A tensile drawing machine applies a drawing tension to the sheet edges to deform the sheet onto the mold. Heated pressurized air supplied through air holes in the mold surface forms an air cushion between the sheet and the mold, to heat and support the sheet without friction. A forming method includes: a pre-stressing phase of pre-stressing and pre-bending the sheet at room temperature and atmospheric pressure; a heating phase of heating the sheet with the pressurized air at an elevated temperature and intermediate elevated pressure; a forming phase of maintaining the temperature and increasing the pressure to support the sheet on the air cushion, and drawing the sheet with the tensile drawing machine; and a cooling phase of cooling the sheet without further deformation, with the air at the intermediate pressure and cooled to room temperature.

11 Claims, 3 Drawing Sheets

METHOD AND APPARATUS FOR FORMING A METAL SHEET UNDER ELEVATED TEMPERATURE AND AIR PRESSURE

PRIORITY CLAIM

This application is based on and claims the priority under 35 U.S.C. §119 of German Patent Application 100 63 287.4, filed on Dec. 19, 2000, the entire disclosure of which is incorporated herein by reference.

FIELD OF THE INVENTION

The invention relates to a method and an apparatus for forming and especially plastically deforming a metal sheet on a forming mold having a mold contact surface with a simple or complex curvature, with a minimized friction between the metal sheet and the mold contact surface.

BACKGROUND INFORMATION

Various methods and apparatus are known in the art for subjecting a metal sheet to a mechanical deformation to impose a curvature on the sheet, by means of a tensile stretching or drawing process. To carry this out, the metal sheet, which is to be deformed, is first arranged on the mold contact surface of a suitable forming mold or the like, and is then subjected to tensile stretching or drawing by suitable tensile drawing apparatus, for example by being clamped and pulled by at least one so-called "clamping shoe". In this context, it is necessary to lubricate the interface between the metal sheet and the mold contact surface of the forming mold, to minimize the friction between the metal sheet and the contact surface of the mold or the tensile drawing means, so as to allow the metal sheet to slide or shift on the mold surface in a compensating manner as the sheet is being drawn. This is necessary so that the intended formed contour can be smoothly and uniformly imposed on the metal sheet, without over-stretching some areas and under-stretching other areas, which would occur if friction between the metal sheet and the mold contact surface prevents smooth straining and deformation of the metal sheet.

Such lubrication of the metal sheet is typically achieved by applying a layer of oil or grease or the like between the mold contact surface and the metal sheet. Unfortunately, thereafter, it is necessary to carry out a degreasing and cleaning operation to remove the oil or grease, so as to prepare the metal sheet for subsequent coating applications or the like, or other subsequent processing steps. For example, it is often necessary to carry out an intermediate annealing of the metal sheet that has been pre-formed in the above manner, and thereafter to further deform the annealed metal sheet in a so-called calibration step in order to achieve the final deformed configuration of the metal sheet, whereby a slight spring-back of the metal sheet must be taken into account to arrive at the final configuration. Before such an intermediate annealing step, it is almost always necessary to degrease the lubricated pre-formed metal sheet.

The above described known methods, which involve several distinct steps utilizing several different processes, are generally rather complicated, time-consuming and thus costly to carry out. Especially, the required intermediate processing steps, such as a degreasing step and an intermediate annealing step, as well as the necessary post-processing steps, such as the calibration deforming step, significantly add to the complexity and cost of the conventional methods. Carrying out such methods with such distinct intermediate steps and processes also requires a substantial amount of additional handling of the metal sheet workpiece, as well as a capital investment in additional molding, heat-treating, and processing equipment for carrying out such several steps and processes.

SUMMARY OF THE INVENTION

In view of the above, it is an object of the invention to provide a method and an apparatus for plastically deforming a metal sheet without requiring additional measures or processes during or in connection with the forming process. Particularly, it is a further object of the invention to avoid the need of a separate heat treatment for improving the plasticity of the metal material of the metal sheet, and to avoid the need of lubricating the workpiece with oil or grease or the like, while still supporting the workpiece on the forming mold in a nearly friction-free manner. The invention further aims to avoid or overcome the disadvantages of the prior art, and to achieve additional advantages, as apparent from the present specification.

The above objects have been achieved according to the invention in an apparatus for forming a metal sheet, including a stretching or drawing mold with a contoured contact surface on which the metal sheet is to be formed, and a tensile drawing machine with which the edges or side margins of the metal sheet are pulled to apply a stretching tension to the metal sheet on the drawing mold. Especially according to the invention, the drawing mold has plural air holes penetrating through the contact surface thereof. These holes are connected to a source of compressed or pressurized air, so as to introduce the pressurized air to form an air cushion between the metal sheet and the contact surface of the drawing mold.

The above objects have further been achieved according to the invention in a method of forming a metal sheet, especially using the apparatus of the invention as described herein. In this method, the metal sheet is subjected to a tensile drawing process in order to form a singly or complexly curved contour, for example a convex or concave or compound curvature, onto the metal sheet. The inventive method further includes the following steps or phases in one particular embodiment thereof.

In a preliminary step, a metal sheet is positioned over the drawing mold and then laid onto the curved or contoured contact surface of the drawing mold. The edges or side margins of the metal sheet located opposite each other in a horizontal plane are secured to the tensile drawing apparatus, which then applies a pre-stressing tension during a defined pre-stressing time on the contoured contact surface of the drawing mold, under the effect of room temperature and normal ambient atmospheric pressure (e.g. without supplying heated pressurized air through the air holes of the mold surface). Thereby, the metal sheet is drawn and deformed from its initial neutral condition into a pre-drawn or pre-bent state by being stretched along a pre-stressing deformation displacement distance.

Next, tempered or heated pressurized air at a constant pre-heating air pressure is introduced through the air holes of the drawing mold, with an increasing temperature until it reaches a heating temperature after the course of a heating time. Thereby, the pressurized air spreads out between the metal sheet contact surface and the drawing mold contact surface to form an air cushion therebetween. Also, during this heating phase, the metal sheet, which is under the above mentioned pre-stress, will be heated up to the above mentioned heating temperature of the heating air, although the drawing tension will not be changed so there will be no further deformation and no change of the pre-drawn or pre-bent condition.

Then, in a subsequent deforming phase, an increased constant deforming air pressure is applied by means of the pressurized air through the air holes so that the metal sheet is supported in a floating manner on the resulting air cushion with essentially no friction relative to the contoured contact surface of the drawing mold. Also during this phase, the temperature of the metal sheet is held constant at the above mentioned heating temperature, and the tensile drawing machine applies an additional drawing strain so that the metal sheet is formed to have a curvature or contour fitting the surface contour of the contact surface of the drawing mold, as the metal sheet is iteratively or stepwise or constantly stretched or drawn further through a forming displacement distance.

Thereafter, in a cooling phase, the pressurized air is cooled down from the heating temperature to room temperature, at a constant cooling air pressure with which it is provided through the air holes of the drawing mold. During this phase, the metal sheet is also cooled down, while maintaining the formed contour that was established in the prior step or phase.

Next, an optional calibrating step may be carried out, whereby the metal sheet, which has been formed through the prior steps, is subjected to a further drawing tension and strain at atmospheric pressure and room temperature, to bring the final curvature or contour of the formed metal sheet to an exact required dimension or configuration.

The method encompasses variations of the above process, and further details of the various steps. For example, the edges of the metal sheet could first be secured to the tensile drawing machine, and thereafter moved downwardly onto the drawing mold, to move and pull the sheet onto the curved mold surface.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 2:
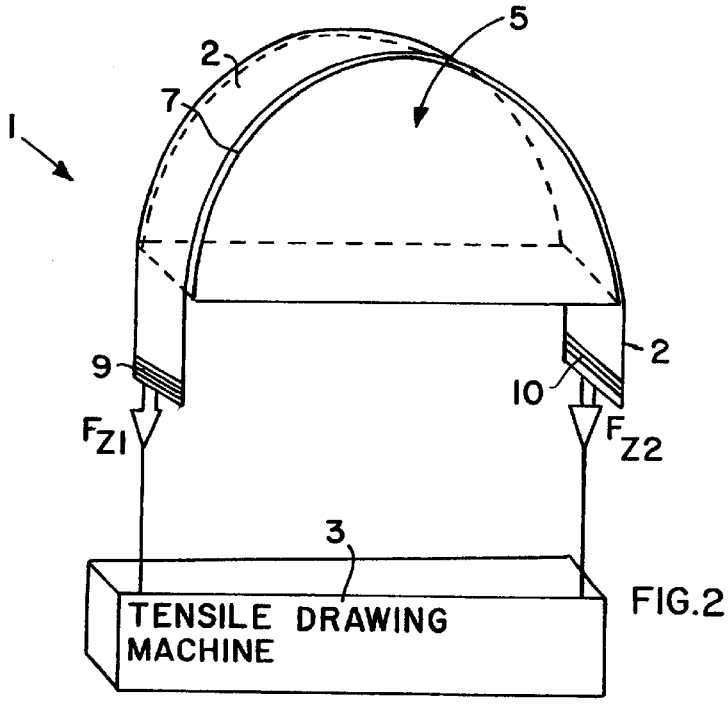
FIG. 2 is a schematic overview of the forming apparatus including the drawing mold and a tensile drawing machine, to which the metal sheet is connected.
Figure 1:
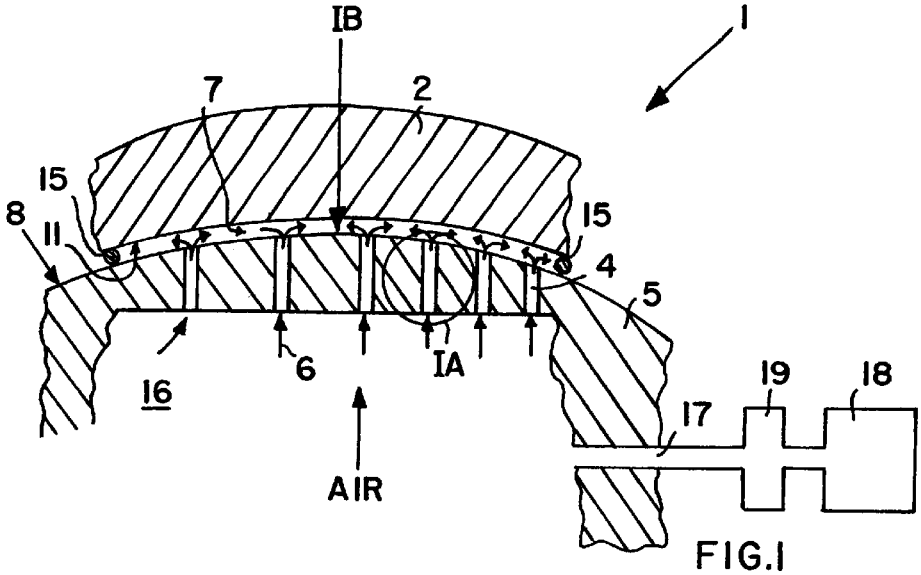
FIG. 1 is a schematic sectional view of a metal sheet being formed on a drawing mold with air holes to provide an air cushion between the metal sheet and the mold.

FIG. 2 shows a general perspective schematic overview of a metal sheet forming apparatus 1 according to the invention, including a stretching or drawing mold 5 for receiving and forming a metal sheet 2 thereon, and a tensile drawing machine 3 for applying a drawing tension to the metal sheet 2. FIG. 1 shows a detailed cross-section of the metal sheet 2 arranged on the drawing mold 5.

The forming contact surface 8 of the drawing mold 5 has a curved contour, and particularly in the present example embodiment has a contour that is curved outwardly or convexly in the horizontal direction, whereby it is intended to impose this contour onto the metal sheet 2 by deforming the metal sheet 2 with its contact surface 11 facing the contact surface 8 of the drawing mold 5

The metal sheet 2 may generally consist of a sheet of essentially any metal material. The method according to the invention described below is suitable for forming essentially any metal of which the strength or stiffness is reduced upon heating the metal. Preferably, the metal material of the metal sheet 2 may be an aluminum alloy that is deformable at room temperature (e.g. 20 to 30° C.), but which may be more easily deformed after having been heated, for example to a temperature in a range from 100 or 200 up to 350° C., due to its resulting reduction in yield stress. For example, particularly, the material of the metal sheet 2 may be any aluminum alloy that is typically used in the field of aircraft construction, which may be a hardenable (e.g. age hardenable) alloy or non-hardenable alloy.

Also, the present apparatus and method are useful for forming metal sheets 2 that have a smooth contact surface 11, as well as those having a textured or otherwise non-smooth contact surface 11, including those with an irregular surface or an irregular curvature or contour. A textured surface may, for example, have grooves, ridges, nubs, impressions, roughness, or wrinkles or the like. Such surface textures are not affected and are not altered by the forming on the mold surface 8 of the drawing mold 5, due to the provision of a friction-preventing pressurized air cushion 7 therebetween as will be described below. Thus, for example, an intended texture of the contact surface 11 of the metal sheet 2 will not be crushed or flattened by a direct bearing contact with the surface 8 of the mold 5.

The drawing mold 5 includes a plurality of air holes 4 which open through the contact surface 8 of the drawing mold 5, preferably extending substantially perpendicularly to the local surface of the contact surface 8. Pressurized air 6 is blown under pressure through the air holes 4 into a space between the contact surface 8 of the drawing mold 5 and the contact surface 11 of the metal sheet 2, so as to form a pressurized air cushion 7 therebetween. This air cushion 7 uniformly distributes itself as a thin pressurized air film or layer between the contact surface 8 of the mold 5 and the contact surface 11 of the metal sheet 2, so as to substantially avoid direct mechanical contact between these two contact surfaces 8 and 11, which thereby reduces or minimizes the friction between the metal sheet 2 and the drawing mold 5. If suitable or necessary to help contain the pressurized air cushion 7, a seal member 15, such as an O-ring, a rubber seal, a bead of sealant, a flange, a gasket, or the like may be provided on the mold 5 between the contact surfaces 8 and 11.

In order to provide the pressurized air 6 to the air holes 4, in the simplest embodiment, the interior of the drawing mold 5 may include a hollow plenum 16 that communicates into each of the air holes 4, and that is connected to an external source of pressurized air such as an air compressor 18 through an air port 17, for example. Alternatively, air delivery channels or passages may be formed in the mold 5 to deliver the pressurized air to the air holes 4. Alternatively, the pressurized air source such as a compressor can be located and incorporated directly inside of the mold 5. Other possibilities will also be apparent to the skilled artisan.

Figure 1A:
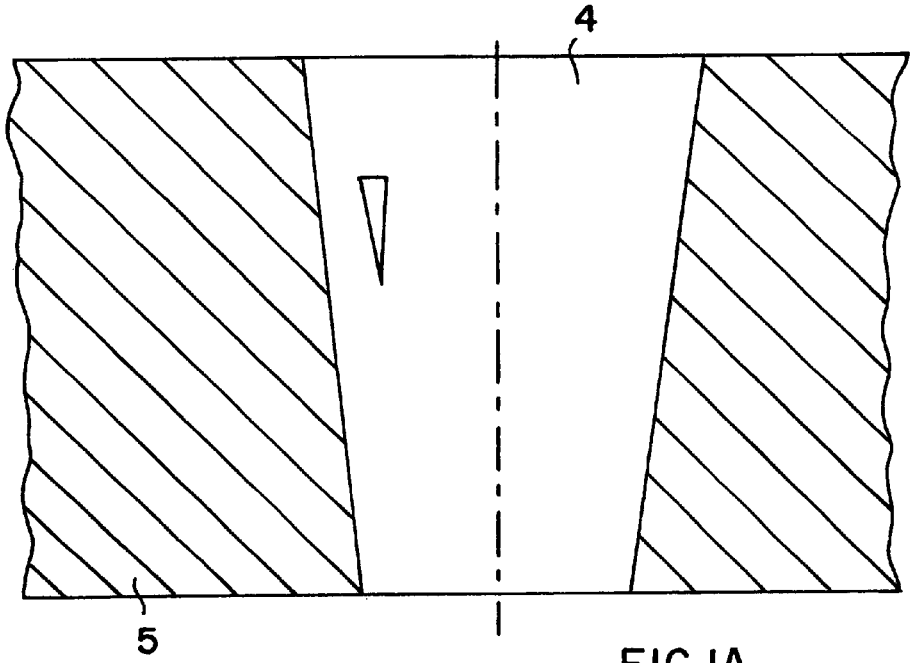
FIGS. 1A and 1B are an enlarged detail view of area IA in FIG. 1, and a plan view of the mold surface in direction IB in FIG. 1, respectively.
Figure 1B:
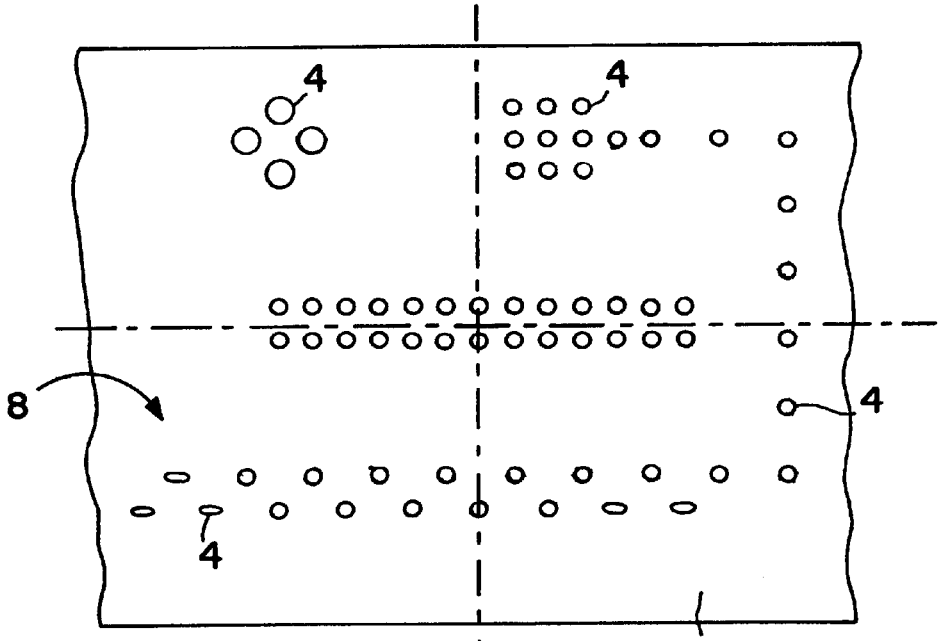

In one embodiment (e.g. FIG. 1), the air holes 4 are distributed uniformly across substantially the entirety of the contact surface 8 of the drawing mold 5 facing the contact surface 11 of the metal sheet 2. Also, the air holes 4 preferably have a uniform and simple configuration, whereby the contact surface 8 of the mold 5 is substantially a uniformly perforated contact surface. Alternatively (e.g. examples in FIG. 1B), the air holes 4 may be provided at only partial areas of the contact surface 8 of the mold 5 underneath the surface 11 of the metal sheet 2, for example to build up an air cushion only around the edges of the sheet 2 or only at the locations of highest deformation force application between the sheet 2 and the mold surface 8. To achieve a nearly friction-less movability of the sheet 2 on the mold surface 8 during the forming process, the pressurized air 6 is always provided at any time during the forming process (or at least during the major forming steps) with a sufficient air pressure to withstand the forming forces being applied to the metal sheet 2 at the time, so that the metal sheet 2 floats on the air cushion 7 during the deforming steps.

The air holes 4 may each be cylindrical bore holes (e.g. FIG. 1), or non-cylindrical holes of a different configuration. An example of such a non-cylindrical hole configuration (shown in FIG. 1A) is an inverted conical or tapering configuration having a relatively larger opening at the contact surface 8 of the drawing mold 5 and a relatively smaller opening communicating with the hollow air plenum 16. Such a conical or tapering hole configuration is less likely to suffer blockages and can be cleaned more easily than a cylindrical hole. In general, the particular choice of the configuration of each air hole 4 can be adapted to the particular conditions and application at hand.

In FIG. 1, an embodiment is shown in which the air source such as an air compressor 18 is located externally and remotely from the drawing mold 5. Alternatively, the pressurized air source 18 could be incorporated directly into the drawing mold 5, whereby the air source 18 would be connected to the individual air holes 4 via the air plenum 16 or other air conveying channels, ducts, pipes or the like as mentioned above. Additionally, means are provided so that the pressurized air 6 may have a pressurized air temperature of up to 350° C. If the output air of the compressor 18 is not at a sufficiently high temperature, an air heater 19 arranged in line between the air compressor 18 and the air holes 4 is controlled to heat the pressurized air 6 to the required temperature for any particular stage of the forming process that will be described below. The heated pressurized air 6 not only forms the pressurized air cushion 7 as described above, but also serves to heat up (or cool down) the metal sheet 2 to the appropriate temperature required for each particular phase of the forming process as will be described below.

To begin the forming process, the metal sheet 2 is carried to, supported over, and then laid down onto the contact surface 8 of the drawing mold 5 by any conventionally known workpiece transport and support devices, which are not shown. The edges or side margins 9 and 10 of the metal sheet 2 protruding from the curved mold surface 8 of the drawing mold 5 are engaged by suitable workpiece engaging members of the tensile drawing machine 3, which then exerts a drawing tensile force $F_{Z1}$ and $F_{Z2}$ to these side margins 9 and 10 of the metal sheet 2, to carry out the drawing process as will be described in greater detail below.

For example, the tensile drawing machine 3 may be connected to the side margins 9 and 10 of the metal sheet 2 using any conventionally known clamping jaws or the like, for example typically known as clamping shoes. Also, the tensile drawing machine 3 may be any known machine for applying a controlled tensile force and displacement to a workpiece, such as a hydraulic piston device, a screw jack with an acme screw driven by an electric motor, etc.

It should further be understood that as an alternative, the side margins 9 and 10 of the metal sheet 2 can already be clamped into the clamping jaws of the tensile drawing machine 3 when the metal sheet 2 is in a flat sheet condition extending horizontally above the drawing mold 5, and an initial pre-stress tension can already be applied to the metal sheet 2 via the side margins 9 and 10 by the tensile drawing machine 3 in this condition. Then the drawing mold 5 is moved upwardly, or the metal sheet 2 being pretensioned by the tensile drawing machine 3 is moved downwardly, to deform the sheet 2 onto the drawing mold 5. Instead, the sheet 2 could first be deflected downwardly over the drawing mold 5, e.g. by hand or by using other apparatus not shown, and thereafter the side margins 9 and 10 may be connected to the clamping jaws of the tensile drawing machine 3 for the drawing tension forces $FZ_{Z1}$ and $F_{Z2}$ to be applied thereto.

During the course of a defined pre-stressing phase until reaching a defined pre-stressing time, the metal sheet 2, via its side margins 9 and 10, is subjected to a pre-stressing force while the sheet 2 is at room temperature and atmospheric pressure, so that the sheet 2 becomes pre-formed or pre-bent from an initial neutral condition into a pre-formed or pre-bent condition having a preliminary curvature generally conformed to that of the curvature of the surface 8 of the drawing mold 5, which involves a pre-stressing deformation displacement of the metal sheet 2 as will be described below.

Figure 3A:
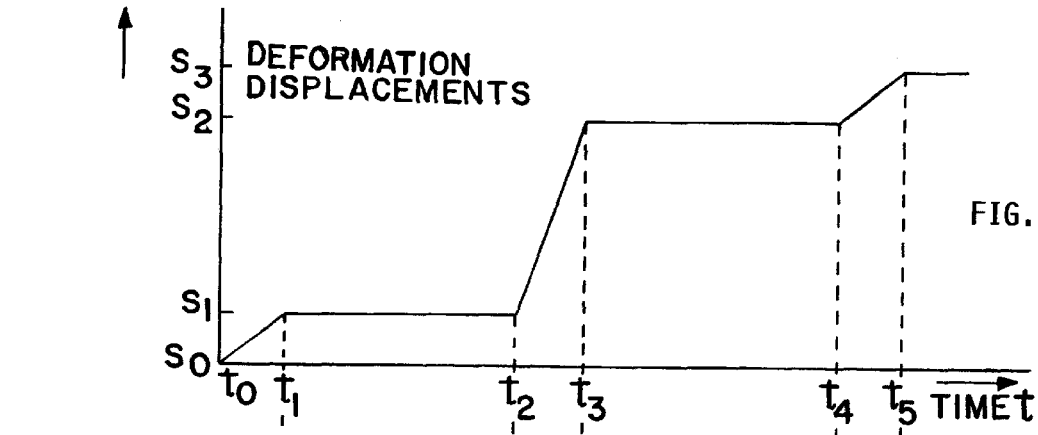
FIGS. 3A, 3B and 3C are diagrams showing the progression of the drawing displacement, the temperature, and the air pressure over the course of time during the forming process according to the invention.
Figure 3B:
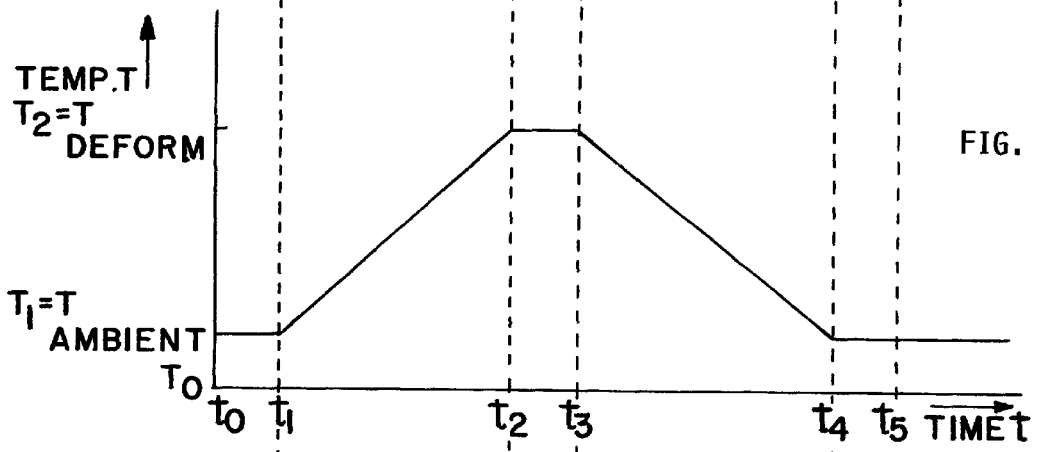
Figure 3C:
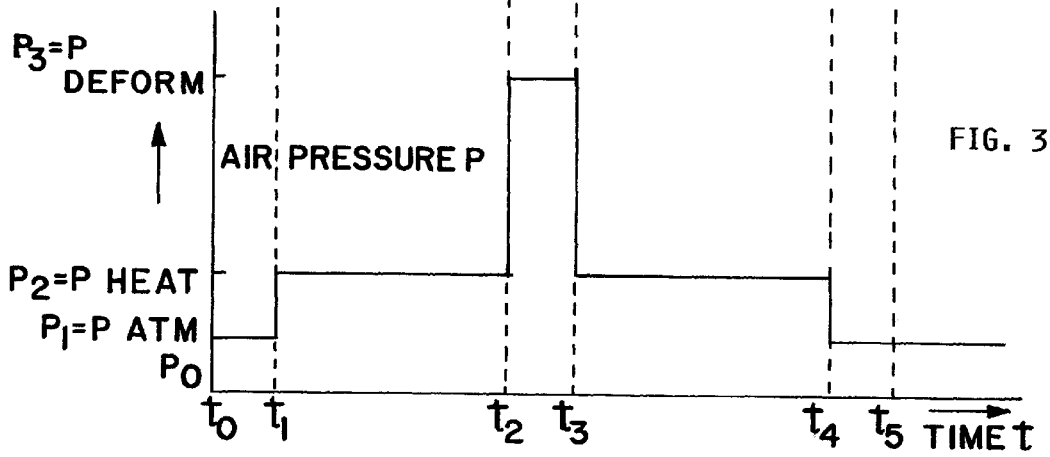

FIG. 3 includes three subfigures, namely FIGS. 3A, 3B and 3C, which respectively show the course or progress of the deformation displacement S, the temperature T, and the air pressure P over time during the several successive steps of the inventive forming process, which is especially suitable to be carried out using the above described metal sheet forming apparatus 1 according to the invention. Thereby, the metal sheet 2 may be formed to have a simple or compound curvature, either in a convex or concave or compound direction, simply depending on the configuration or contour of the contact surface 11 of the drawing mold 5. The details of an example embodiment of such a process as shown in FIGS. 3A, 3B, and 3C will now be described.

The above described metal sheet 2 is first positioned over the drawing mold 5 and then laid down onto the curved contact surface 8 of the mold 5. Next, the edges or side margins 9 and 10 of the metal sheet 2 that are located opposite each other in a horizontal plane and protruding beyond the convexly formed curved surface 8 of the drawing mold 5 are secured, preferably clamped, to the tensile drawing machine 3. The protruding side margins 9 and 10 of the metal sheet 2 are preferably clampingly secured to the tensile drawing machine 3 directly adjoining or close to the edge of the curvature of the contact surface 8 of the drawing mold 5, so as to minimize the margin areas 9 and 10 that will not be subjected to the contouring or forming process. Once these preparatory steps have been carried out, the forming process itself can be started.

In a pre-stressing phase from the start time to to the pre-stressing time $t_1$, a pre-stressing tension is applied by the machine 3 to the metal sheet 2 under the effect of room temperature $T_1$ and ambient atmospheric pressure $P_1$ until reaching the pre-stressing time $t_1$. Thereby, the metal sheet 2 is deformed or bent from an initial neutral condition to a pre-formed or pre-bent condition by having been stretched or drawn through a pre-stressing deformation displacement $s_1$, such that the metal sheet 2 now has the general curved shape of the contact surface 8 of the drawing mold 5.

Next, during a heating phase from the pre-stressing time $t_1$ to the heating time $t_2$, heated pressurized air is provided by the compressor 18 and the air heater 19 at a constant elevated pre-heating air pressure $P_2$ and at an air temperature that reaches the elevated heating temperature $T_2$ at heating time $t_2$. This heated pressurized air 6 is supplied through the air holes 4 of the drawing mold 5, so as to form a heated pressurized air cushion 7 between the contact surface 8 of the mold 5 and the contact surface 11 of the metal sheet 2. Thereby, the metal sheet 2, which is still subjected to the pre-stressing tension, is further heated to the heating temperature $T_2$ and (at least partially) supported by the constant heating air pressure $P_2$ during this heating phase from time $t_1$ to time $t_2$. During this phase, the metal sheet 2 is not subjected to any further deformation, i.e. does not show any additional deformation displacement beyond the pre-stressing displacement $s_1$ which is maintained constant through this phase.

Thereafter, in the main forming or deforming phase from the heating time $t_2$ to the forming time $t_3$, the pressurized air 6 is provided at a significantly higher forming air pressure $P_3$, and the temperature of the pressurized air 6 is maintained at the elevated heating temperature $T_2$. Thereby, the metal sheet 2 is held floating on the pressurized air cushion 7 in a substantially friction-free manner relative to the contact surface 8 of the drawing mold 5. In the example of FIG. 3C, the forming air pressure $P_3$ is, e.g., a three-fold multiple in terms of gage pressure, relative to the pre-heating air pressure $P_2$. However, in general, the forming air pressure $P_3$ is selected at whatever pressure level is necessary for floatingly supporting the metal 20 sheet 2 on the pressurized air cushion 7 in a substantially friction-free manner during the forming phase from time $t_2$ to time $t_3$. Namely, at least during this forming phase, the contact surface 11 of the metal sheet 2 is floatingly supported on the air cushion 7 so that it substantially does not physically contact the contact surface 8 of the drawing mold 5. The required forming air pressure $P_3$ thus depends on the forming tension force that is being applied to the metal sheet 2, as well as the surface area of the metal sheet being supported by the air cushion. As an example, the forming pressure $P_2$ is selected to achieve a pressure of the air cushion 7 relative to the supported area of the metal sheet 2 of e.g. 100 or 150 up to 200 bar. The heating temperature $T_2$ of the pressurized air 6 in this phase is e.g. 100 or 200 up to 350° C.

During this forming phase from time $t_2$ to time $t_3$, the metal sheet 2 is formed over the contact surface 8 of the drawing mold 5 so that the metal sheet profile will match the contour of the mold 5. This is achieved by applying the required forming tension to the side margins 9 and 10 of the metal sheet 2 by means of the tensile drawing machine 3. This results in a further deformation displacement from $s_1$ to $s_2$ as shown in FIG. 3A.

In the next successive cooling phase from the forming time $t_3$ to the cooling time $t_4$, the pressurized air 6 is cooled down to the ambient room temperature $T_1$ and is again reduced to and constantly held at an intermediate pressure such as the above mentioned pre-heating air pressure $P_2$ to maintain an air cushion 7 between the mold 5 and the metal sheet 2, while the metal sheet 2 is cooled down to room temperature $T_1$ without being subjected to any further deformation, i.e. the metal sheet 2 maintains the previously established configuration with the total deformation displacement $s_2$. The cooling of the metal sheet achieved during the cooling phase from time $t_3$ to time $t_4$ has a positive influence on the contour accuracy and the spring-back condition of the deformed metal sheet 2.

The above described basic process according to the invention can be carried out with various alternatives, variations, or additional steps. For example, after the above described steps that are carried out until reaching the completion of the cooling time $t_4$, a further calibrating phase may be carried out from time $t_4$ to completion time $t_5$ as follows. In this calibrating phase, the temperature is maintained constantly at room temperature $t_1$, and the pressure is reduced to and then maintained at atmospheric pressure $P_1$ (e.g. the supply of pressurized air may be discontinued) while the metal sheet 2 is subjected to a further fine-tuning or calibrating deformation to bring the deformed shape of the metal sheet 2 to a final required precise shape, whereby the metal sheet undergoes a further deformation from the total deformation displacement $s_2$ to the final calibrated deformation displacement $s_3$.

A further variation of the inventive method involves the preliminary steps or stages thereof. According to this varied method, the side margins 9 and 10 of the metal sheet 2 are first secured to the clamping devices of the tension drawing machine 3, along a flat horizontal plane. Thereafter, the metal sheet 2 is positioned over the drawing mold 5, and then either the metal sheet 2 is lowered or the drawing form 5 is raised until the sheet 2 is laid down onto the curved contact surface 8 of the mold 5. Then, the side margins 9 and 10 of the metal sheet 2 are pre-stressed and bent down over the curved surface of the drawing mold 5 under the effect of room temperature $T_1$ and ambient atmospheric air pressure $P_1$ until reaching a defined pre-stressing time $t_1$, whereupon the metal sheet 2 has reached the above mentioned preformed for pre-bent condition with a deformation displacement $s_1$. Only then is the pressurized air 6 provided through the air holes 4 of the mold 5 at a constant air pressure $P_2$ and reaching a heating temperature $T_2$ at the end of the heating time $t_2$. This pressurized air 6 forms the air cushion 7 as described above. The rest of the forming process is carried out as described above.

In the inventive method, since the metal sheet 2 is supported in a contact-less floating manner on the air cushion 7 during at least the forming phase of the process, the inventive method can entirely omit the use of lubricant such as oil or grease between the mold 5 and the metal sheet 2. This simplifies and economizes the forming process, and also avoids the need for later degreasing and cleaning processes. The inventive method further avoids the need of an intermediate annealing step as has generally been required in prior art methods.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A method of forming a metal sheet comprising:

arranging a metal sheet on a contoured mold surface of a drawing mold;

providing heated pressurized air through at least one air hole in said mold surface so as to form an air cushion between said mold surface and said metal sheet, and varying a pressure and a temperature of said heated pressurized air; and applying a mechanical drawing tension to said metal sheet arranged on said mold surface with said air cushion therebetween, so as to draw and deform said metal sheet on said mold, wherein said varying of said pressure and said temperature of said heated pressurized air, and said applying of said mechanical drawing tension comprise the following phases:

a heating phase which includes heating said pressurized air to a heating temperature above room temperature and providing said pressurized air at a first constant pressure above atmospheric pressure to form said air cushion, whereby said metal sheet is heated to said heating temperature, without drawing and deforming said metal sheet during said heating phase;

a deforming phase which takes place after said heating phase and which includes maintaining said pressurized air at said heating temperature and providing said pressurized air at a second constant pressure above said first constant pressure to form said air cushion, and applying said mechanical drawing tension so as to draw and deform said metal sheet from a first condition to a second condition during said deforming phase; and a cooling phase which takes place after said deforming phase and which includes cooling said pressurized air down to room temperature and providing said pressurized air at a third constant pressure above atmospheric pressure and below said second constant pressure, whereby said metal sheet is cooled down from said heating temperature, without further drawing and deforming said metal sheet so that said metal sheet maintains said second condition during said cooling phase.

2. The method according to claim 1, further comprising a pre-stressing phase which takes place before said heating phase and which includes applying said mechanical drawing tension so as to draw and deform said metal sheet from an initial condition to said first condition which is a pre-stressed and pre-bent condition, without providing said heated pressurized air or while maintaining said heated pressurized air at room temperature and atmospheric pressure.

3. The method according to claim 2, further comprising a calibrating phase which takes place after said cooling phase and which includes applying said mechanical drawing tension so as to draw and deform said metal sheet from said second condition to a final calibrated condition, without providing said heated pressurized air or while maintaining said heated pressurized air at room temperature and atmospheric pressure.

4. The method according to claim 1, further comprising a calibrating phase which takes place after said cooling phase and which includes applying said mechanical drawing tension so as to draw and deform said metal sheet from said second condition to a final calibrated condition, without providing said heated pressurized air or while maintaining said heated pressurized air at room temperature and atmospheric pressure.

5. The method according to claim 1, wherein said first constant pressure is equal to said third constant pressure.

6. The method according to claim 1, wherein said second constant pressure is up to 200 bar and said heating temperature is up to 350° C.

7. The method according to claim 1, wherein said metal sheet is floatingly supported on said air cushion and thereby lifted away from said contoured mold surface at least during said deforming phase.

8. The method according to claim 1, wherein said applying of said mechanical drawing tension comprises securing two opposite edge margins of said metal sheet, which are directly adjacent to and protrude from said contoured mold surface, to a tensile drawing machine and applying a tension with said tensile drawing machine.

9. The method according to claim 8, wherein said securing of said two opposite edge margins of said metal sheet comprises clamping said edge margins respectively into gripping clamps of said tensile drawing machine, and said applying of said tension comprises pulling said gripping clamps vertically downwardly.

10. The method according to claim 1, excluding the application of an oil or grease lubricant onto said metal sheet.

11. The method according to claim 1, excluding a subsequent or intermediate step of annealing said metal sheet.

* * * * *